US007780121B2

(12) United States Patent
Ashton et al.

(10) Patent No.: US 7,780,121 B2
(45) Date of Patent: Aug. 24, 2010

(54) WAYSIDE SIGNAL APPARATUS WITH ADJUSTABLE SIGNAL POSITION

(75) Inventors: Michael Lee Ashton, Lee's Summit, MO (US); Paul A. Keck, Callahan, FL (US)

(73) Assignee: General Electric Company, Schenectady, NY (US)

( * ) Notice: Subject to any disclaimer, the term of this patent is extended or adjusted under 35 U.S.C. 154(b) by 704 days.

(21) Appl. No.: 11/270,993

(22) Filed: Nov. 12, 2005

(65) Prior Publication Data

US 2006/0251454 A1 Nov. 9, 2006

Related U.S. Application Data

(60) Provisional application No. 60/678,302, filed on May 6, 2005.

(51) Int. Cl.
*B61L 5/12* (2006.01)

(52) U.S. Cl. ..... 246/473 R

(58) Field of Classification Search ..... 246/473 R, 246/473.1, 477, 484, 485, 486
See application file for complete search history.

(56) References Cited

U.S. PATENT DOCUMENTS

| | | | | |
|---|---|---|---|---|
| 1,435,807 | A | 11/1922 | Conley | |
| 1,591,399 | A | 7/1926 | Nickell | |
| 2,097,785 | A | 11/1937 | Field | |
| 3,952,978 | A * | 4/1976 | Reinitz | 246/477 |
| 4,073,453 | A | 2/1978 | Thomas | |
| 4,152,756 | A | 5/1979 | Wrege et al. | |
| 4,261,027 | A | 4/1981 | Chapman et al. | |
| D357,881 | S | 5/1995 | Chinn et al. | |
| 5,433,166 | A | 7/1995 | Donatello et al. | |
| 5,697,584 | A | 12/1997 | Chew | |
| 5,746,036 | A | 5/1998 | Angelette | |
| 6,006,861 | A | 12/1999 | Clinton | |
| 6,189,839 | B1 * | 2/2001 | Lemieux | 246/293 |
| 6,435,459 | B1 | 8/2002 | Sanderson et al. | |
| 6,642,666 | B1 | 11/2003 | St-Germain | |
| 6,663,052 | B1 | 12/2003 | Brushwood | |
| 6,683,540 | B1 | 1/2004 | Harrison | |
| 6,714,140 | B2 | 3/2004 | Enguiluz Fernandez | |

OTHER PUBLICATIONS

Fabricated Metals, LLC, Walkout Cantilevers. http://www.fabricatedmetals.com/mast.htm.
Safetran. A-2-1 to A-2-3. Walkout Cantilever Model WT/F.

(Continued)

*Primary Examiner*—S. Joseph Morano
*Assistant Examiner*—Robert J McCarry, Jr.
(74) *Attorney, Agent, or Firm*—Robert Wawrzyn, Esq.; Terry M. Sanks, Esq.; Beusse Wolter Sanks Mora & Maire, P.A.

(57) ABSTRACT

A railroad wayside signal cantilever (10) including an arm (22) with a signal mounting apparatus (28) that provides a degree of horizontal movement of the signal (26) relative to the cantilever mast (12). The available range of locations for securing the signal on the arm is sufficiently broad to allow a single cantilever design to be used for a wide range of site-specific locations. An extendable catwalk railing (54) is provided to accommodate movement of the signal without creating an unsafe gap between the railing and the signal.

11 Claims, 7 Drawing Sheets

OTHER PUBLICATIONS

Safetran. C-1-1 to C-1-10. Color Light Signals: Model CLC-20R/V-20R.
Safetran. C-10-1 to C-10-2. Wayside Signal Bridge.
Safetran. C-7-1 to C-7-8. Wayside Signal Mast and Ladder Assemblies with Platforms.
Safetran. C-8-1 to C-8-2. Wayside Signal Cantilever: Mode QNR.
Safetran. C-12-1 to C-12-4. Color Light Signal: Type V-R with rear serviceable optical modules.

* cited by examiner

WAYSIDE SIGNAL APPARATUS WITH ADJUSTABLE SIGNAL POSITION

This application claims benefit of the May 6, 2005, filing date of U.S. provisional application No. 60/678,302, incorporated by reference herein.

FIELD OF THE INVENTION

This invention relates generally to the field of railroad wayside signals and more specifically to wayside signal cantilever structures.

BACKGROUND

A variety of structures are currently used to support railroad wayside signal indicators. Posts and pads are used to mount signals at the side of a rail line. Bridge structures are used to support signals above a rail line. Bridge structures include two mast/post structures disposed on opposite sides of a rail line, with an arm structure supported between the two masts at a height above the rail line. One or more signal devices are affixed to the arm structure at predetermined locations relative to the rails.

Cantilever structures are also used to support a wayside signal above a rail line. Cantilever structures advantageously require a footprint on only one side of the rail line. A wayside signal cantilever, such as for example a Model QNR available from Safetran Systems Corporation of Louisville, Ky., includes a single mast mounted next to the rail line and supporting an arm in cantilever fashion to extend over a rail line at a predetermined height. Signal devices are affixed to the arm structure at predetermined locations relative to the rails. Cantilever structures are available for rail lines consisting of one, two or three parallel tracks.

DETAILED DESCRIPTION OF THE INVENTION

Dimensional requirements for overhead wayside signals vary as a function of the number of tracks, the desired location of the signal relative to the track, the location of available space for the mast footprint relative to the tracks, and other railroad and application specific variables. As a result, each order issued by a railroad for the purchase of a wayside signal cantilever is treated as a unique project based upon its location, with each project requiring site-specific drawings and undergoing engineering and administrative review to ensure that the site-specific requirements are satisfied.

The present inventors have innovatively developed a railroad wayside signal cantilever structure that provides improved flexibility and potentially lower cost and faster delivery than prior art wayside signal cantilevers. The wayside signal cantilever of the present invention incorporates a signal mounting apparatus that provides a degree of adjustment in the location of the signal(s) on the arm. The inventors have found that it is possible to utilize a single cantilever design for a large majority of the wayside signal cantilevers for various U.S. railroad systems by providing a mechanism for adjustment of the signal location to any position within plus or minus six inches of a center position (one foot range of adjustment for the signal closest to the mast). The use of such a standardized yet adjustable design allows for on-site customization of the location of the signal(s) on the mast in response to site-specific requirements without the need for site-specific engineering prior to fabrication.

Figure 1:
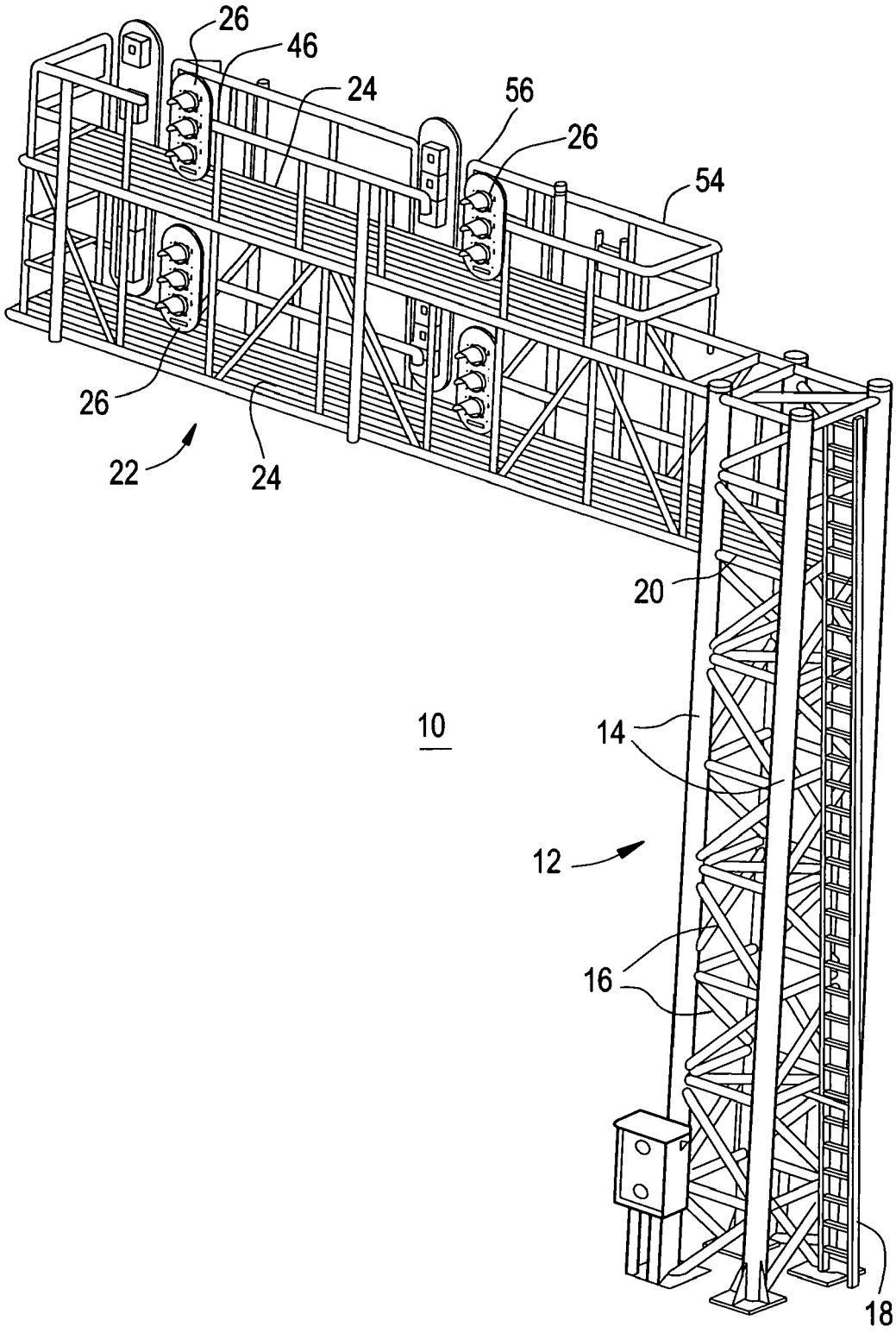
FIG. 1 is a perspective view of a wayside signal cantilever including adjustable signal mounting structures.
Figure 2:
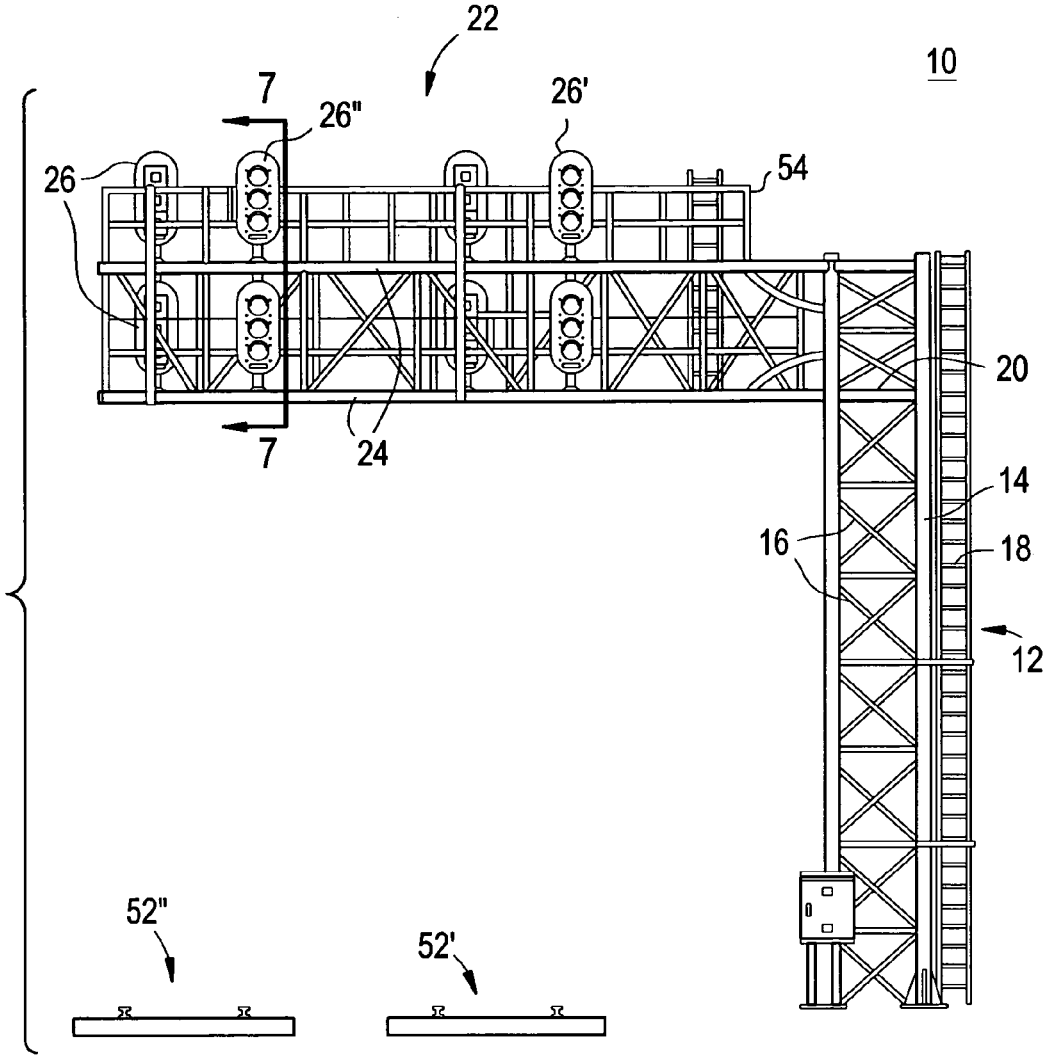
FIG. 2 is a side view of the cantilever of FIG. 1.
Figure 3:
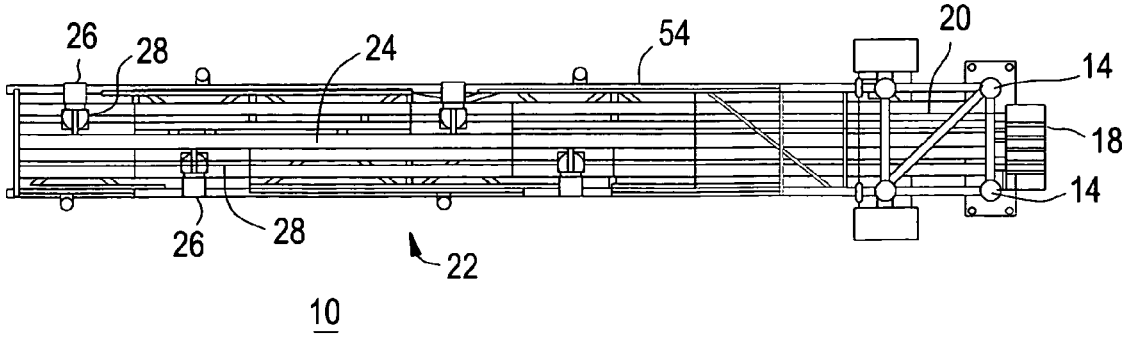
FIG. 3 is a top view of the cantilever of FIG. 1.

One embodiment of a railroad wayside signal cantilever 10 is illustrated in perspective view in FIG. 1, in side view in FIG. 2, and in top view in FIG. 3. In this embodiment, the mast 12 is constructed with four vertically oriented tubular columns 14 interconnected by bridgework 16 of cross-bracing members. Other mast designs may be utilized in other embodiments. A ladder 18 may be provided for operator access to a catwalk platform 20 that extends into the upper section of the mast. The mast 12 is secured to a foundation (not shown) in any manner known in the art. The arm 22 of the cantilever 10 of FIG. 1 is formed of a box frame structure providing two levels of catwalks 24 for access to two levels of signals 26. Other embodiments may include only a single level.

Figure 4:
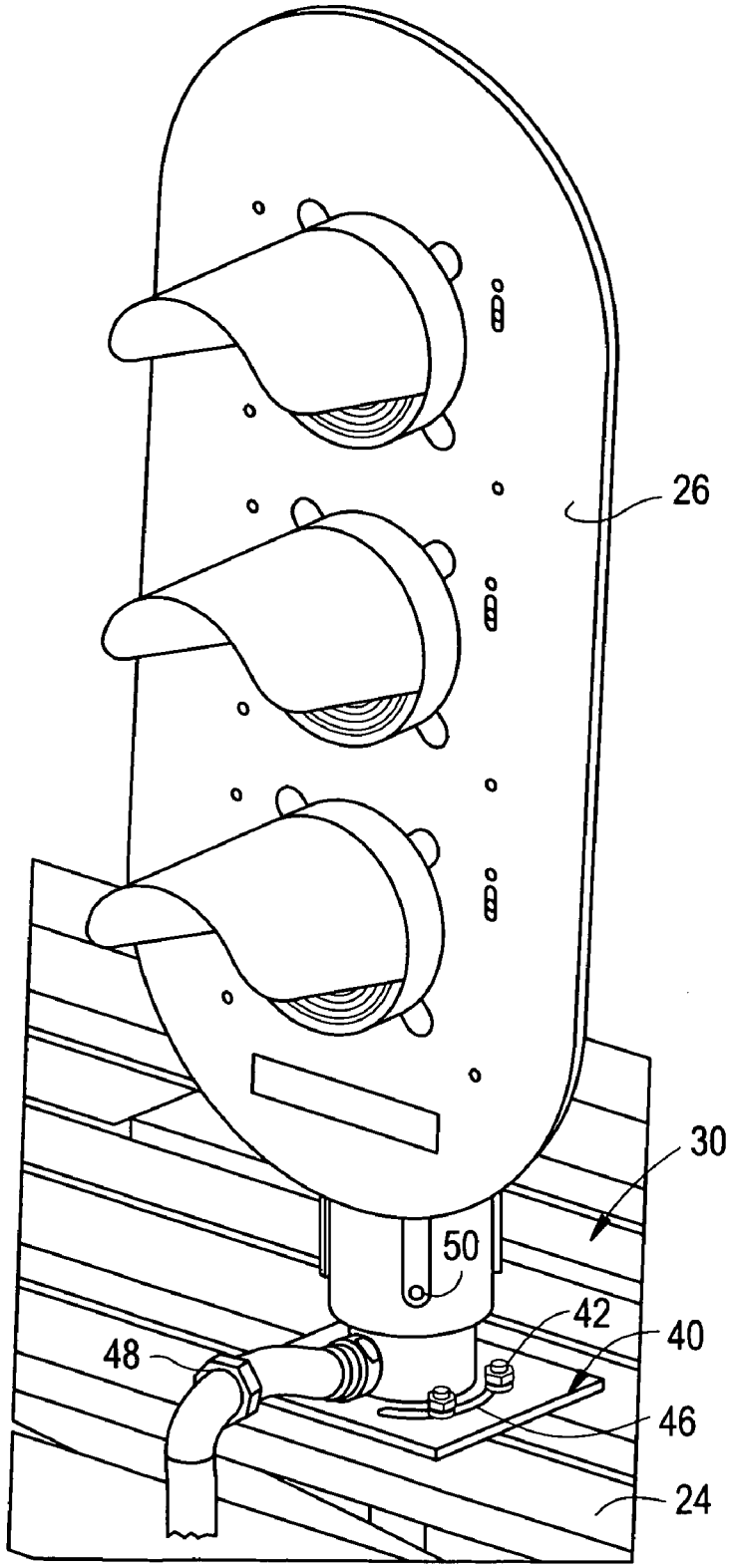
FIG. 4 is a perspective view of a signal and associated mounting apparatus of the cantilever of FIG. 1.
Figure 5:
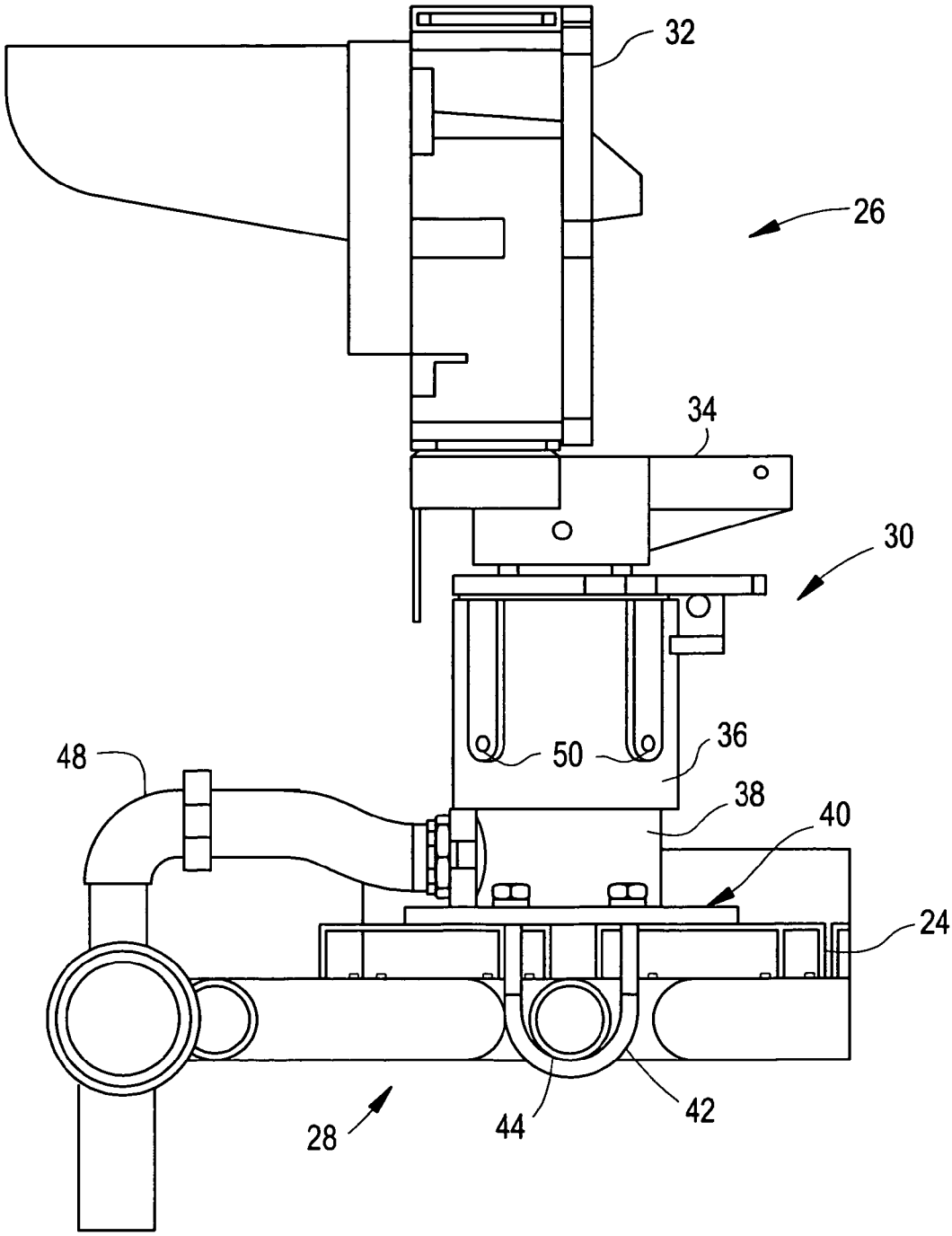
FIG. 5 is a partial side view of the signal and associated mounting apparatus of FIG. 4.
Figure 6:
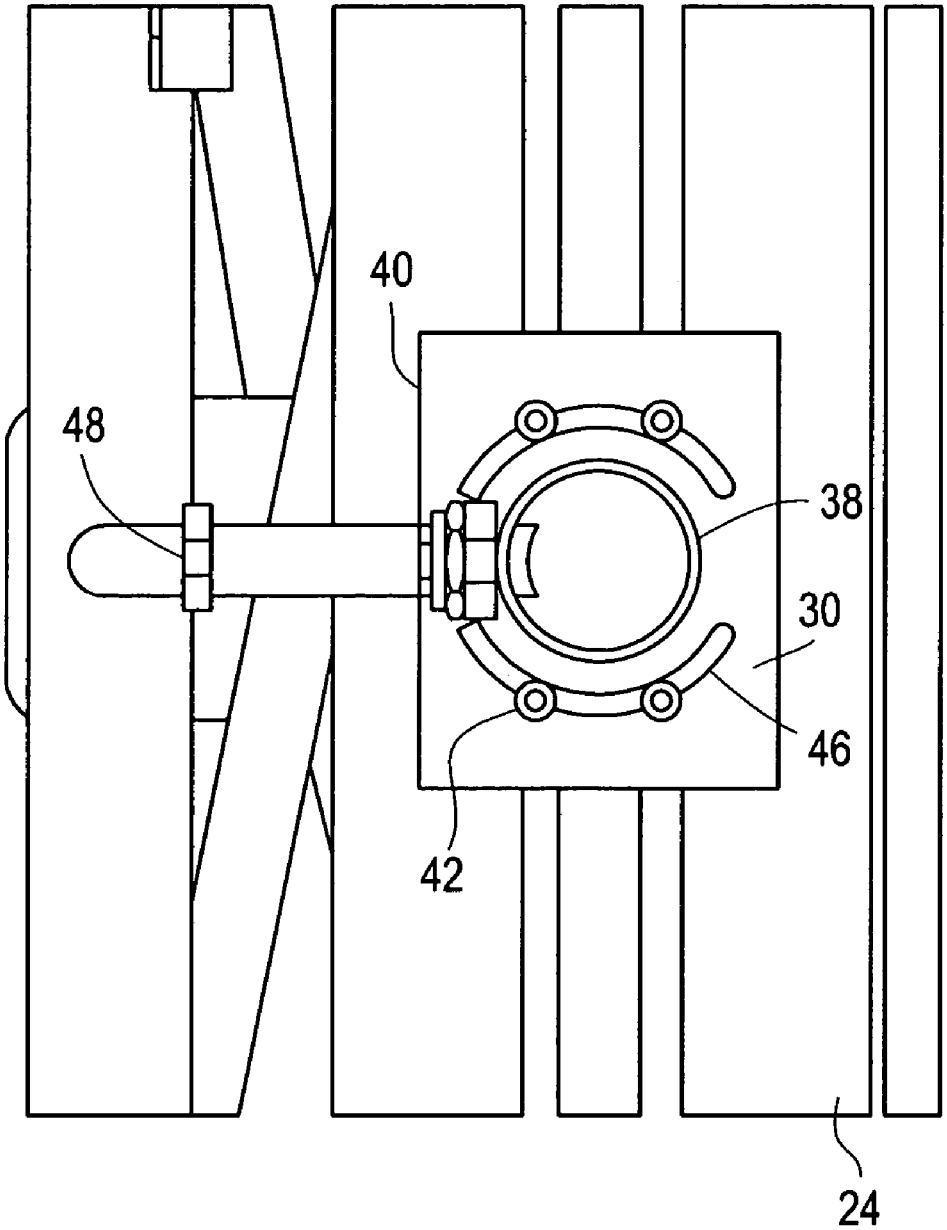
FIG. 6 is a top view of the mounting apparatus of FIG. 4 with the signal removed.
Figure 7:
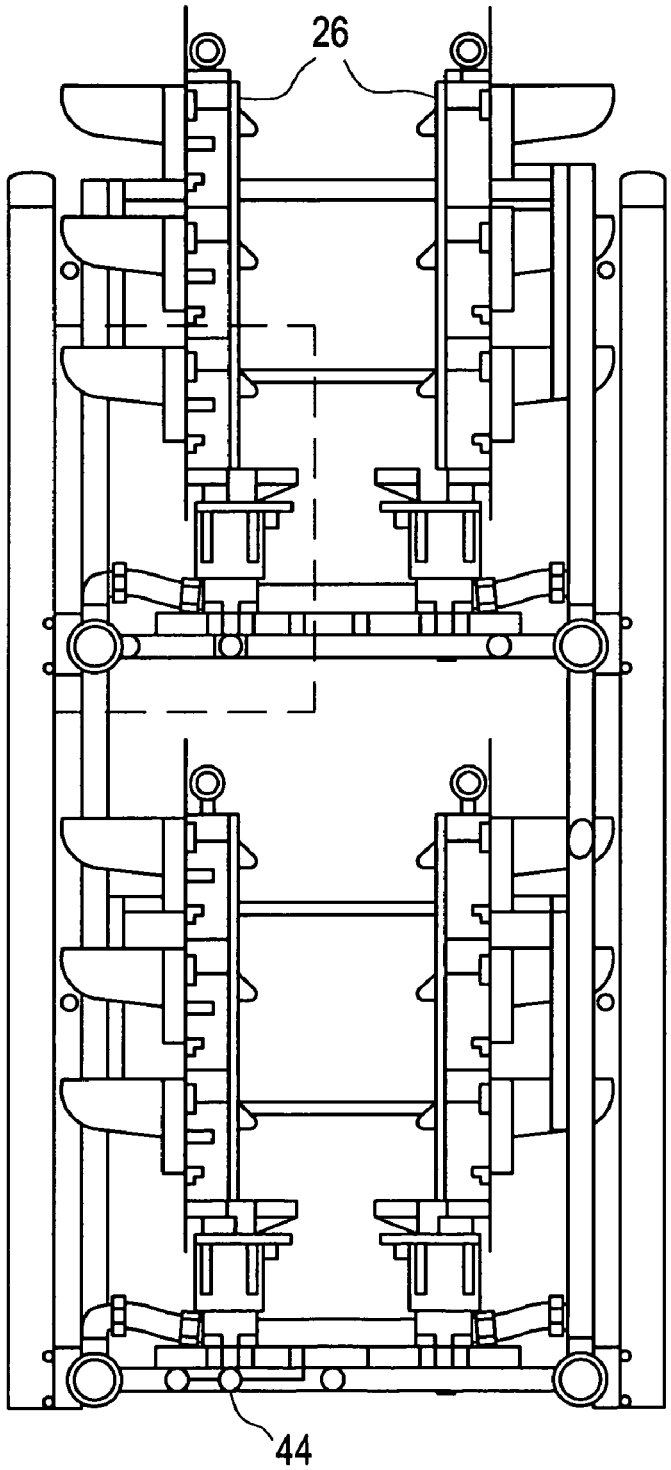
FIG. 7 is a sectional view of the cantilever of FIG. 1.

The signals 26 illustrated in FIG. 1 are standard three-lamp color light assemblies such as the Model CLS-20R supplied by Safetran Systems Corporation. Other types of signals may be used in other applications. The signals 26 are mounted to the arm 22 with an adjustable mounting apparatus 28 that allows the signal 26 to be secured to the arm 22 within a range of positions in a horizontal direction relative to the mast 12. The illustrated embodiment of an adjustable mounting apparatus 28 is best appreciated by viewing FIGS. 4-7. FIG. 4 is a perspective view of the mounting of a representative signal 26 of the cantilever 10 of FIG. 1. FIG. 5 is a side view of the signal mount pedestal 30 used for mounting of the signal 26 of FIG. 4. FIG. 6 is a top view of the pedestal 30 of FIG. 5 with the signal removed to better illustrate aspects of the pedestal 30. FIG. 7 is a sectional view through the arm 22 of the cantilever 10 of FIG. 1 as seen at section 7-7 of FIG. 2.

The signal 26 includes a lamp housing 32 and a base assembly 34. The adjustable mounting apparatus 28 of this embodiment of the present invention includes a sleeve 36 attached to a bottom of the signal base assembly 34 for receiving a vertically extending portion 38 of pedestal 30. The pedestal 30 further includes a mounting plate 40 attached to the vertically extending portion 38 and adapted for adjustable attachment to the arm structure 22 via two U-bolt assemblies 42 including respective U-bolts and associated nuts and optionally washers. The U-bolts extend around opposed sides of a tubular member 44 of the arm 22 and extend upward through arcuate slots 46 in the pedestal mounting plate 40. When the U-bolt assemblies 42 are tightened, the signal 26 is affixed into the selected position on the arm 22 relative to the mast 12. However, when the U-bolt assemblies 42 are loosened, the signal 26 may be moved horizontally across a range of positions relative to the mast 12 as the U-bolts are slid along the tubular member 44. Appropriate openings/slots are provided through the catwalk decking 24 as necessary to accommodate the movement of the U-bolts. The arcuate slot 46 in the pedestal mounting plate 40 allows the pedestal 30 to be rotated as it is moved horizontally in order to facilitate alignment of the pedestal 30 with the attached electrical cable conduit 48. Once the pedestal 30 is affixed into a desired position by tightening the U-bolt assemblies 42, the sleeve 36 may be rotated about the upwardly extending portion 38 of the pedestal 30 to accomplish alignment with the cable conduit 48 prior to tightening the plurality of setscrews 50 provided for securing the angular position of the sleeve 36/signal 26 relative to the upwardly extending portion 38. The standard prior art signal assembly also provides a degree of angular rotation and vertical tilt of the lamp housing on its base assembly 34.

In one embodiment the range of horizontal motion of each signal 26 is one foot; i.e. ±six inches from a nominal position on the arm 22. Thus, the position of each signal 26 can be adjusted horizontally along the arm 22 relative to the location of the mast 12 by one foot, such as to accommodate the desire of one railroad to place the signal 26 above a position midway between the two rails of a track 52 and the desire of another railroad to place the signal off-center of the track 52. The spacing between two adjacent signals 26 in the horizontal direction is thus adjustable by up to two feet with the signals at their respective extreme positions, thereby accommodating a range of distances between adjacent parallel tracks 52. Other embodiments may provide greater or lesser ranges of horizontal adjustment, with the range of adjustment for each signal 26 not necessarily being the same as that of the others. For example, a first signal 26' for a first track 52 most adjacent the mast 12 may have a range of motion of ±1 foot, with a second signal 26" for a second track 52" farther away from the mast 12 having a range of motion of ±2 feet in order to allow the second signal 26" to be adjusted to a position ±1 foot from a nominal distance from the first signal 26' no matter where in its range the first signal 26' is positioned. Similarly, a third signal even farther away from the mast 12 (not illustrated) may be provided with an even greater range of motion in order to accommodate the variable positions of both the first signal 26' and the second signal 26".

Figure 8:
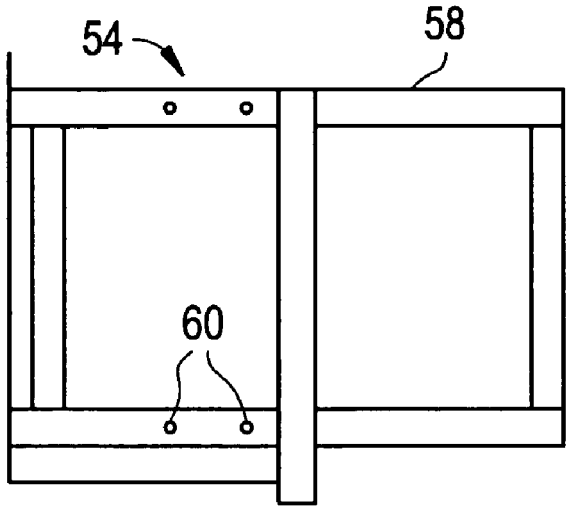
FIG. 8 is a detail view of the handrail of the cantilever of FIG. 1 showing an adjustable insert.

The arm of the cantilever of FIG. 1 is provided with railings 54 along the catwalks 20 for personnel safety. The signals 26 are positioned within respective openings 56 in the railings 54 in order not to obscure the visibility of the signal 26 from a passing train. The railing 54 adjacent the respective signals 26 may be provided with an adjustable insert 58, such as illustrated in FIG. 8, in order to selectably extend the railing 54 to at least partially close the opening 56 when the signal 26 is secured at a selected location. Once the signal 26 is affixed into the desired position, the railing insert 58 is slid horizontally to a desired position. The insert 58 is then secured at that position such as with field-installed fasteners 60. Other embodiments of an adjustable insert may include a folding accordion section or a rolling member to accommodate movement of the signal 26 while maintaining the safety of the railing 54.

A cantilever 10 incorporating the present invention may be designed to comply with all relevant standards of design and construction; for example those promulgated by The American Railway Engineering and Maintenance of Way Association (AREMA) and/or the American Association of State Highway and Transportation Officials (AASHTO). Known materials and procedures may be used for the engineering, manufacturing, erection and maintenance of a cantilever embodying the invention. The use of a standardized cantilever 10 providing a range of available horizontal positions for the signals 26 may provide a savings of 20-40 man-hours in the processing of a purchase order for a cantilever for a particular site and may preclude the need for site-specific drawings. Furthermore, should the requirements for a particular location change, such as a change by a railroad in the desired location of the signals 26 relative to the tracks 52, such a change may be accommodated without the replacement of or major modification to the installed cantilever 10.

Figure 9:
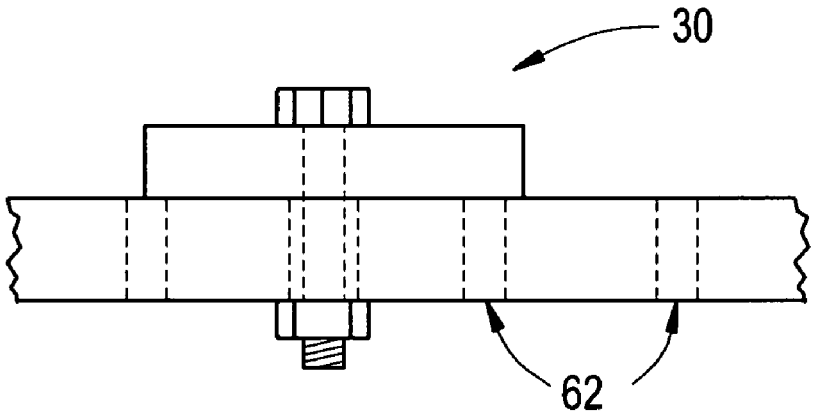
FIG. 9 is a side view of a signal mounting apparatus providing for a plurality of discrete signal positions.

One skilled in the art will appreciate that other embodiments of the invention are possible, and that the embodiments illustrated and discussed herein are provided by way of example and are not meant to be limiting. For example, many other forms of attachment providing a plurality of discrete positions and/or a continuously variable range of positions for the signal 26 may be envisioned. As illustrated in FIG. 9, discrete positions may be provided by a plurality of holes 62 or notches to which a signal pedestal 30 may be inserted/secured. Alternatively, continuously variable positions may be provided along a rail or channel along which a signal mount may be moved. Such a signal mount may be secured to the rail or channel or separately to another arm structure via clamps, bolts, adhesives and/or any known type of fastener. The present invention may be embodied in cantilevers for use over one, two or three parallel tracks 52, and having single or multiple vertical levels of signals 26 and catwalks 20. The invention may further be embodied in a signal adjustably attached to an arm extending over a track regardless of whether the arm is supported in cantilever fashion, in bridge fashion or otherwise.

The invention claimed is:

1. A railroad wayside signal apparatus comprising:
a mast;
an arm supported in cantilever fashion from the mast for extending over a rail Line;
a plurality of signals , each signal attached to the arm at any of a plurality of horizontal positions relative to the mast by a respective mounting apparatus, each mounting apparatus configured to horizontally adjust its respective signal independent of the other signals, to provide a range of horizontal adjustment of each signal relative to the mast;
a catwalk along the arm;
a railing wherein the railing is disposed along the catwalk at locations remote from the signal; and
a railing insert for selectably extending the railing into an area proximate the signal when the signal is secured at any of the plurality of positions;
wherein each mounting apparatus includes an arcuate slot in a horizontal plane, and at least one fastener assembly positioned within the arcuate slot; and
wherein at least one signal of the plurality of signals is adjustable about a vertical axis, based on said at least one fastener assembly being loosened within the arcuate slot.

2. A railroad wayside signal apparatus comprising:
a mast;
an arm supported in cantilever fashion from the mast for extending over a rail line;
a plurality of signals , each signal attached to the arm at any of a plurality of horizontal positions relative to the mast by a respective mounting apparatus, each mounting apparatus configured to horizontally adjust its respective signal independent of the other signals, to provide a range of horizontal adjustment of each signal relative to the mast;
wherein the mounting apparatus further comprises:
a pedestal comprising a vertically extending portion;
a sleeve attached to the signal and receiving the vertically extending portion of the pedestal; and a fastener selectably securing the pedestal to the arm at any of the plurality of positions;

and wherein the range of horizontal adjustment provided for a first signal is less than a range of horizontal adjustment provided for a second signal disposed on the arm farther from the mast than the first signal.

3. The apparatus of claim 2, wherein the fastener comprises a U-bolt extending around a member of the arm and through an opening in a mounting plate of the pedestal.

4. The apparatus of claim 3, wherein the opening comprises an arcuate opening receiving an end of the U-bolt and allowing rotation of the pedestal relative to the arm member.

5. A railroad wayside signal apparatus comprising:

an arm for extending over a track;

a signal mounting pedestal;

a fastener adapted for independently fastening the signal mounting pedestal to the arm at a plurality of horizontal positions relative to the track; and a signal connected to the signal mounting pedestal, wherein the signal mounting pedestal is operable to allow the signal to rotate about a vertical axis.

6. The apparatus of claim 5, further comprising:

the arm comprising a tubular member extending in a horizontal direction; and the fastener comprising a U-bolt assembly extending around the tubular member and through an opening in the signal mounting pedestal.

7. The apparatus of claim 6, wherein the opening comprises an arcuate opening allowing rotational movement of the pedestal relative to the tubular member as the pedestal is moved between alternative positions on the arm.

8. The apparatus of claim 5, further comprising:

a catwalk along the arm;

a railing wherein the railing is disposed along the catwalk at locations remote from the signal; and a railing insert for selectably extending the railing into an area proximate the signal when the signal is secured at any of the plurality of horizontal positions.

9. The apparatus of claim 5, wherein the fastener may be secured to the arm through any of a plurality of holes wherein the holes are at different horizontal positions relative to the mast.

10. The apparatus of claim 5, wherein the fastener may be secured to the arm at any location along the arm within a range of horizontal locations.

11. A railroad wayside signal apparatus comprising:

a mast;

an arm supported in cantilever fashion from the mast for extending over a rail line;

a lower catwalk and an upper catwalk supported on the arm;

a signal independently secured to the arm by a mounting apparatus operable to secure the respective signal at any of a plurality of horizontal positions, and operable to permit the signal to rotate about a vertical axis;

a railing supported along each catwalk wherein the railing is disposed at locations on the catwalk remote from the signal; and an adjustable insert associated with each railing that is selectably extendable to extend the railing into an area proximate the signal when the respective signal is secured at a selected location.

* * * * *